US006257516B1

(12) United States Patent
Fritzson et al.

(10) Patent No.: US 6,257,516 B1
(45) Date of Patent: Jul. 10, 2001

(54) AXIAL DISC BRAKE AND YARN FEEDING DEVICE INCLUDING AN AXIAL DISC BRAKE

(75) Inventors: Joachim Fritzson; Kurt Arne Gunnar Jacobsson; Lars Helge Gottfrid Tholander, all of Ulricehamn (SE)

(73) Assignee: IRO AB, Ulricehamn (SE)

( * ) Notice: Subject to any disclaimer, the term of this patent is extended or adjusted under 35 U.S.C. 154(b) by 0 days.

(21) Appl. No.: 09/155,705

(22) PCT Filed: Mar. 25, 1997

(86) PCT No.: PCT/EP97/01523

§ 371 Date: Jul. 26, 1999

§ 102(e) Date: Jul. 26, 1999

(87) PCT Pub. No.: WO97/37069

PCT Pub. Date: Oct. 9, 1997

(30) Foreign Application Priority Data

Apr. 1, 1996 (DE) ..... 196 13 055

(51) Int. Cl.[7] ..... B65H 51/20; B65H 59/22; D03D 47/36

(52) U.S. Cl. ..... 242/365.4; 242/150 R; 242/419.1; 139/452

(58) Field of Search ..... 242/365.4, 419.1, 242/150 R; 139/452

(56) References Cited

U.S. PATENT DOCUMENTS

| | | | | |
|---|---|---|---|---|
| 3,455,341 | * | 7/1969 | Pfarrwaller et al. . | |
| 3,834,635 | * | 9/1974 | Pfarrwaller | 242/365.4 |
| 3,897,916 | * | 8/1975 | Rosen | 242/365.4 X |
| 4,017,038 | * | 4/1977 | Paepke | 242/365.4 X |
| 4,059,240 | * | 11/1977 | Laursen | 242/365.4 |
| 4,153,214 | * | 5/1979 | Savio et al. | 242/365.4 |
| 4,161,297 | * | 7/1979 | Vella | 242/365.4 |
| 4,261,526 | * | 4/1981 | Roj | 242/365.4 |
| 4,351,495 | * | 9/1982 | Lindstrom et al. | 242/365.4 |
| 4,799,517 | | 1/1989 | Bucher . | |
| 5,094,275 | * | 3/1992 | Shaw et al. | 139/452 |
| 5,123,455 | * | 6/1992 | Maina | 139/452 |
| 5,343,899 | * | 9/1994 | Jacobsson et al. | 139/452 |
| 5,409,043 | * | 4/1995 | Zenoni et al. | 139/452 |
| 5,546,994 | * | 8/1996 | Sarfati | 139/452 |
| 5,678,779 | * | 10/1997 | Maina | 242/365.4 |
| 6,058,982 | * | 5/2000 | Fritzson | 139/452 |
| 6,095,449 | * | 8/2000 | Gallo et al. | 242/365.4 |

FOREIGN PATENT DOCUMENTS

| | | | |
|---|---|---|---|
| 3640515 | * | 6/1987 | (DE) . |
| 0 243 565 A1 | | 11/1987 | (EP) . |
| 0 536 088 A1 | | 4/1993 | (EP) . |
| 0 652 312 A1 | | 5/1995 | (EP) . |
| 855358 | * | 7/1998 | (EP) . |
| 243 141 | | 11/1925 | (GB) . |
| WO 91/14032 | | 9/1991 | (WO) . |
| 9717277 | * | 5/1997 | (WO) . |
| 9823520 | * | 4/1998 | (WO) . |

* cited by examiner

*Primary Examiner*—Michael R. Mansen
(74) *Attorney, Agent, or Firm*—Flynn, Thiel, Boutell & Tanis, P.C.

(57) ABSTRACT

An axial disc brake, particularly for a yarn feeding device, having braking surfaces which are axially pressed against each other with a predetermined yieldable contact pressure. One of said braking surfaces has a spherical convex shape, and the other braking surface is conical with a cone axis lying at least approximately along the axis of the disc brake. The axial disc brake can be provided at the front end of a storage drum of a yarn feeding device of a projectile or gripper weaving machine, such that the yarn withdrawn from the storage drum rotates like the pointer of a clock along a yarn guiding surface and directly enters into the contact zone of the braking surfaces without deflection, and is deflected after having passed the contact zone gently in the axial direction.

20 Claims, 2 Drawing Sheets

AXIAL DISC BRAKE AND YARN FEEDING DEVICE INCLUDING AN AXIAL DISC BRAKE

FIELD OF THE INVENTION

The present invention relates to an axial disc brake as well as to a yarn feeding device having an axial disc brake.

BACKGROUND OF THE INVENTION

In an axial disc brake as known from WO91/14032, intended for the weft yarn rotatingly withdrawn from a storage drum of a yarn feeding device by a textile machine, in one embodiment the mutually contacting braking surfaces are provided exactly perpendicular to the axis of the storage drum. In a further embodiment, the braking surface provided on the front side of the storage drum is oriented precisely perpendicular to the storage drum axis, while the other braking surface is formed by a convexly rounded outer edge of a funnel-shaped braking element having a funnel angle of almost 180°. The braking surface which is perpendicular to the storage drum axis in a further embodiment is unitarily formed with the storage drum. In case of an overhead-withdrawal of the yarn from the storage drum the yarn is rotating like the pointer of a clock and then is entering essentially axially and from the outer side in between the braking surfaces. The yarn is braked by the braking surfaces and then is withdrawn approximately centrally via an opening provided in one of the braking surfaces. In the embodiment having braking surfaces oriented exactly perpendicular to the storage drum axis the yarn is deflected twice by 90°. Such strong deflection may mean under undesirable conditions high load for the yarn and might lead to undefined friction conditions. Centering one of the braking elements on the axis of the storage drum is without problems because of the orientation of the braking surface exactly perpendicular to the storage drum axis. However, a lateral displacement of the braking element, e.g. caused by an axial component of the yarn tension exerted onto said brake element, may cause a disturbance of the mutual contact between both braking surfaces. With the strong deflection of the yarn when entering in between the braking surfaces the friction force depends on the deflection angle and increases by an exponential function depending on said deflection angle and might be superimposed onto the actual braking effect between the braking surfaces. This might lead to a high yarn breakage quota in case of vulnerable yarn qualities like cheap woolen- or cotton-yarns of low quality.

In a yarn brake of a yarn feeding device as known from EP-A-652312, a braking surface having a circumferentially continuous extension and the shape of a frusto-cone coat directly contacts the rounded withdrawal rim of the storage drum of said yarn feeding device. The axis of said frusto-cone coat of said braking surface approximately coincides with the axis of said storage drum. The other barking surface is defined by said rounded withdrawal rim of said storage drum and is designed—in an axial section of said storage drum with a curvature following a circle arc section. The center of said circle arc section is situated inside said storage drum, but is positioned a significant radial distance from the storage drum axis. The frusto-conical braking surface is formed by a deformable band. In case of precise centering of the band in relation to the storage drum axis, the contact zone between the braking surfaces is a full circle. In case that the yarn is forced through the contact zone and/or a small lateral displacement or tilt of the axis of the frusto-cone coat occurs in relation to the storage drum axis, the form of the contact zone changes into a geometrical form other than a full circle.

It is an object of the invention to create an axial disc brake of the kind as disclosed above as well as a yarn feeding device with which a yarn geometry can be achieved which is advantageous for the yarn, avoids strong deflections, and which is accompanied by a correct mutual centering of the braking surfaces with proper mutual contact relationship in their contact area between the braking surfaces.

Said task can be achieved according to the invention by providing an axial disc brake having a pair of form stable braking surfaces axially yieldably pressed against one another with predetermined contact pressure. The braking surfaces define an inlet gap in the area of an outer circumference of the disc brake, with the downstream braking surface having a central withdrawal opening. A braking element is provided which is movably supported at least in the axial direction. One of the braking surfaces is spherically convex with the sphere center thereof located approximately along the axis of the disc brake, and the other braking surface is conical with a cone axis approximately coinciding with the axis of the disc brake. The generatrix of the cone of the other braking surface in the contact zone of the respective braking surfaces is a tangent to the generating circle of the spherical other braking surface. The above disc brake can advantageously be provided on a yarn feeding device for a textile machine, particularly a projectile or gripper weaving machine, the yarn feeding device having a yarn storage drum for overhead yarn withdrawal, which storage drum is provided frontally with a withdrawal region defining a circular yarn guiding surface, wherein the disc brake is arranged coaxially with the storage drum adjacent a front end thereof.

Due to the cooperation between the spherical braking surface and the conical braking surface in contact therewith, the mutual contact zone is inclined, in which contact zone the withdrawn yarn is braked. The withdrawn yarn is drawn from the exterior towards the central withdrawal opening and is simultaneously rotating like the pointer of a clock about the axis of the disc brake. As a result, a very advantageous yarn geometry with weak deflection is achieved. The incoming yarn enters into the contact zone in a straight manner and is then deflected only gently behind the contact zone and into the withdrawal opening. In addition, constant contact relationships and a proper mutual centering of the braking surfaces result from the cooperation of the braking surfaces, since the contact zone remains a full circle even with deviations of the cone axis in relation to the axis of the disc brake or the storage drum, and even when the spherical braking surface becomes displaced. The diameter of said full circle remains unchangeable due to the geometrical conditions. Due to the advantageous yarn geometry the danger of yarn breakages is small since the yarn coming from the yarn guiding surface without deflection enters the disc brake while rotating like the pointer of a clock and is only gently deflected behind the contact zone of the braking surfaces. The reduction of the respective deflection angle and the avoidance of any deflection in the entrance area of the disc brake has a particularly positive effect on the yarn, because of the strong exponential influence of the deflection angle. The yarn is braked practically only in the contact zone such that the constant braking effect of the braking surfaces leads to a very advantageous, almost constant yarn tension in the outgoing yarn. Occasionally occurring relative displacements between the breakage surfaces do not change the contact- and braking relationships between the braking surfaces, since the full circle of the contact zone is maintained constantly as the braking surfaces are apt to automatically mutually align each other in a correct way. Also manufacturing- or assembling-tolerances are without significant influence on the braking effect due to the perfect cooperation between the conical braking surface and the spherical convex braking surface. The spherical convex braking surface is provided at the entrance side of the yarn. The center of the sphere is positioned in or along the axis of the disc brake or the storage drum, respectively.

In one embodiment, the tangent corresponding to the conical braking surface defines an angle of less than 90° with respect to the brake axis, and the orientation of the tangent essentially determines the entrance-direction of the yarn such that the yarn follows an optimal yarn geometry without deflection at the entrance side and with gentle deflection at the withdrawal side only.

In another embodiment, a concentric circular yarn guiding surface is provided upstream of the disc brake and has an outer diameter which is larger than the outer diameter of the brake. The contact zone between the braking surfaces is axially spaced from the yarn guiding surface such that a theoretical extension of the tangent in the contact zone is approximately tangent to the yarn guiding surface. The disc brake brakes on a smaller diameter than the diameter of the yarn guiding surface. The yarn thus follows an optimal path without deflection into the disc brake.

In yet another embodiment, the front side of the storage drum itself defines the spherical braking surface or supports a braking body having the spherical braking surface. The other brake element is supported in a holder and is axially movable. A brake-drive actuates the braking element with an actuation force which is suitable for the desired braking effect, and in a yieldable way, such that the braking element is apt to fulfill all movements necessary during the dynamic phase of the yarn withdrawal for automatically maintaining a constant braking effect. Space is saved in the axial direction of the storage drum since the brake elements are optimally provided close to the storage drum.

In still another embodiment, the braking body is supported at the front end of the storage drum such that same is capable of tilting to all sides about a support center, and is additionally supported with radial clearance. The braking body is apt to automatically adapt to the respective relative position of the braking element, e.g. by tilting motions or by radial displacement motions.

The braking body can be made from metal or plastic and has the shape of a sphere with an outer edge flange and a central depression. The braking body is thus simple to manufacture and guarantees long periods of time wherein the brake effect is constant. The edge flange and the centrally provided depression increase the form staiblity of the brake body and allow its simple fixation. The edge flange extending rearwardly defines a safety factor by means of which entrance of the yarn behind the brake body is prevented in a structually simple way.

The brake element can be made from metal or plastic and has the shape of a funnel with an outer edge flange and a central yarn funnel having a funnel angle which is smaller than the cone angle of the conical braking surface. The brake element is simple to manufacture and guarantees long periods of time wherein the braking effect is constant. The outer edge flange increases form stability of the braking element and prevents an accidental entering of the yarn behind the braking element. The yarn funnel leads to a gentle withdrawal motion of the yarn and can advantageously serve to there receive a yarn eyelet for optimum friction- and deflection-relationships.

A particularly advantageous yarn geometry can be achieved with a cone angle range of the conical braking surface between 90° and 160°. An optimum value of the cone angle is about 1200 in order to achieve symmetrical yarn geometry.

To enable an instantaneous and sensitive response of the disc brake, a diameter range of the circular contact zone of the braking surfaces is between 10% and 50% of the maximum diameter of the yarn guiding surface. Having such a relatively small diameter in the contact zone makes it possible to manufacture the braking elements of lightweight material. Advantageously, the yarn rotating along the yarn guiding surface like the pointer of a clock runs freely between the yarn guiding surface and the contact zone over a relatively long distance such that inherent movements of the yarn within the distance are not transferred significantly into the contact zone where they could be detrimental for the braking effect. Additionally, the long free yarn distance between the yarn guiding surface and the contact zone results in a strong pointer rotational movement so that the yarn is drawn in correctly and radially into the contact zone independent from its linear yarn speed.

In another embodiment, the brake drive is provided with at least one spring element which contacts the braking element in a circle which is substantially axially aligned with the contact zone of the braking surfaces. The contact force between the braking surfaces is precisely selectable by means of the spring element. The braking element may, if necessary, yield (also when a knot is passing). It is of particular importance that the spring element acts approximately in the same diameter as the diameter of the contact zone such that a straight force transmission results from the spring element into the contact zone.

In still another embodiment, a membrane is fixed to the edge flange of the braking element and prevents the entrance of the yarn behind the braking element. Furthermore, the braking element can be lifted from the braking body by means of the membrane and a suction actuation of a suction chamber in order to allow a comfortable threading of the yarn (manually or by means of a pneumatic threading device). The membrane does not have any detrimental influence on the normal braking effect. However, the membrane may contribute to the centering of the braking element.

In a further embodiment, the brake drive is provided with an electrically, electromagnetically or pneumatically actuatable return drive which counters the actuation force of the spring element and is connected to the braking element. Such disc brakes are suitable for projectile or gripper-weaving machines in order to vary the braking effect during each insertion cycle depending on the weaving cycle. The return drive disengages or relieves the axial disc brake in operational phases during which no or only a minimum braking is necessary, e.g. at the start of an insertion, after the changeover phase or at the end of the insertion. By means of the spring elements a basic braking effect is adjusted which then can be lowered or modulated by the return drive.

The braking element, and also the braking body, may be constructed of lightweight metal and carry, preferably at the braking surfaces, a wear-resistant coating.

Since the pointer movement of the yarn entering the disc brake is a basic prerequisite for an optimum function of the disc brake, it is very advantageous to combine the axial disc brake with a second upstream braking device, e.g. a braking device acting in the region of the yarn guiding surface of the storage drum in order to stabilize the yarn with low tension in the entrance area into the axial disc brake. The second braking device may be a braking ring equipped with bristles or the like cooperating with the storage drum by contact. The geometrical forms of the spherical or conical braking surfaces need not be exactly derived from a sphere or a cone. Since the relative displacements of the braking surfaces have only relatively small magnitudes, an optimally operating axial disc brake also can be achieved in case both braking surfaces slightly deviate from a precise geometrical sphere- or cone-shape.

BRIEF DESCRIPTION OF THE DRAWINGS

Embodiments of the invention will be explained with reference to the drawings, in which.

DETAILED DESCRIPTION

Figure 1:
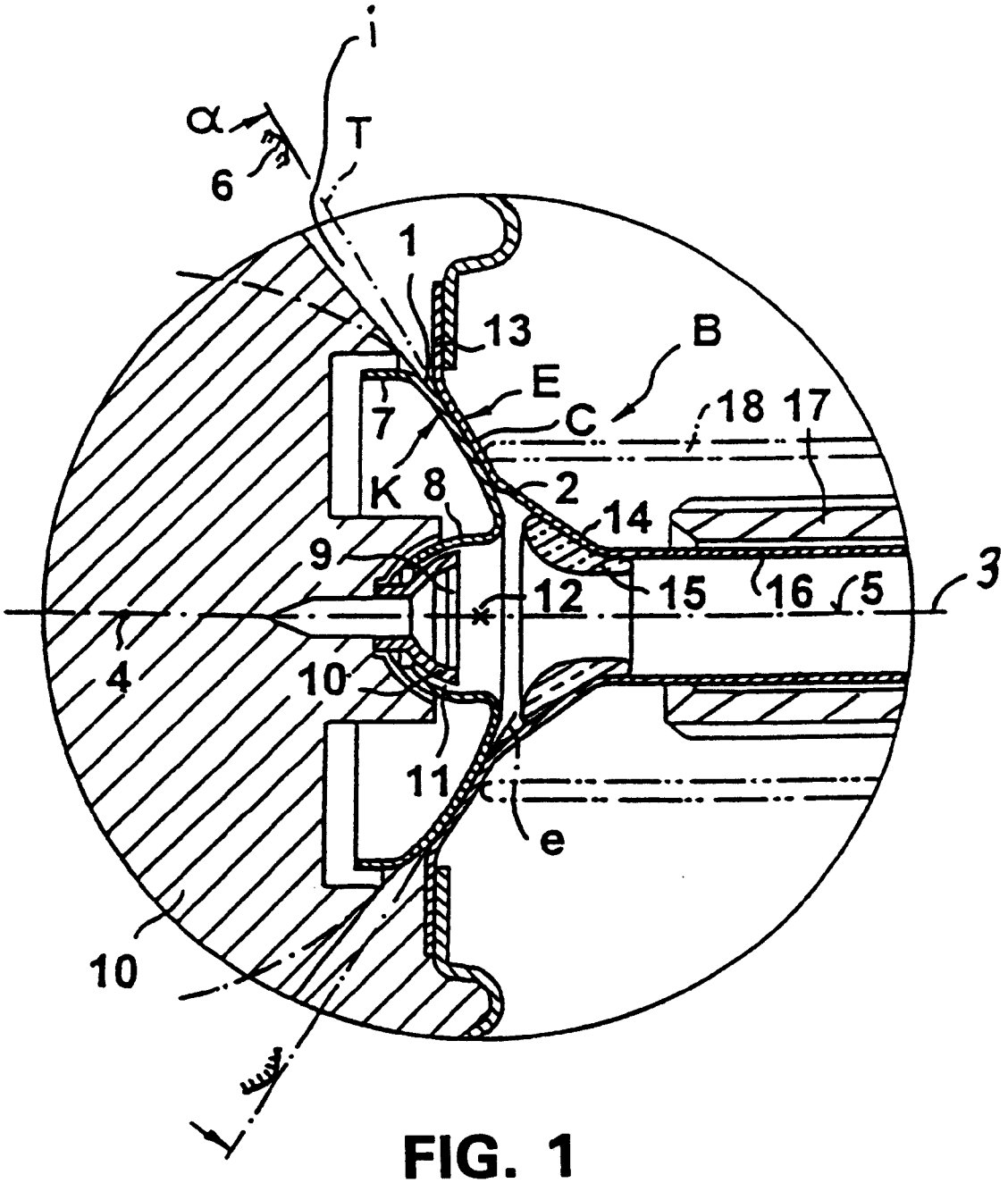
FIG. 1 is a longitudinal section of a first embodiment of an axial disc brake.

An axial disc brake B in FIG. 1 consists in its most important components of a braking body K against which a coaxial braking element E is pressed such that braking surfaces 1, 2 which are rotationally symmetrical to the axis 3 of the disc brake B and which are provided at the braking body K and at the braking element E are brought against each other with selectable pre-load in a circle-shaped contact zone C. The axial disc brake B serves to brake a yarn (not shown) which is drawn through in between the braking surfaces 1, 2. The phrase "axial disc brake" means that the drawn through yarn runs parallel to the direction of the axis 3 of the yarn brake and undergoes a displacement into said axis 3. In operation, the not shown yarn in FIG. 1 enters from the exterior an inlet gap i formed between the braking body K and braking element E, and then passes the contact zone C and finally is axially withdrawn through a centrally provided withdrawal opening e of braking element E.

In FIG. 1 said braking surface 1 is spherical and convex with a sphere center 4 which coincides with the axis 3 of the disc brake B. The other braking surface 2 of braking element E cooperating with braking surface 1 is conical and contacts the spherical convex braking surface in the common contact zone C. The straight generatrix of the conical braking surface 2 thus forms a tangent T at the spherical convex braking surface 1. The cone angle $\alpha$ may be between 90° and 160° but is suitably about 120°. The cone axis 5 of the conical braking surface 2 coincides at least approximately with the axis 3 of the axial disc brake.

Concentric to axis 3 a circular yarn guiding surface 6 is provided at which the yarn straightly entering into the inlet gap i is guided such that during its withdrawal motion it carries out a rotating movement like the pointer of a clock about axis 3 and runs—seen in the direction of axis 3—approximately radially towards axis 3. The diameter of the yarn guiding surface is bigger than the diameter of the full circle in contact zone C. The diameter of the full circle in contact zone C may lie e.g. between 10 and 50%, preferably 15 to 25% or about 17%, of the diameter of said yarn guiding surface 6.

At the braking body K an essentially axial, circumferentially continuous edge flange 7 can be provided as well as a central depression 8. A fixing element 9 having a lining 10 engages within depression 8 in order to support the braking body K at a carrier 10 such that it can be tilted in limited fashion towards all sides. In addition a radial play 11 is suitable there in order that the braking body is apt to undergo radial displacements or movements with limited magnitude. It is possible to load braking body K with a weak centering spring in FIG. 1 from the left side. The tilting center 12 of braking body K is preferably situated approximately in the plane of contact zone C.

Braking element E is of generally funnel-shaped design. An outer radial edge flange 13 continues the conical braking surface 2. Centrally said braking surface 2 is provided with said withdrawal opening e which in the shown embodiment is limited by a funnel section 14 in which a yarn eyelet 15 is located. A cylindrical tube section 16 continues said funnel section 14 and serves as a guiding section. Funnel section 14 is slidably guided with a small clearance in a guide or sleeve 17. The contact force between the braking surfaces 1, 2 in contact zone C is generated by a spring element 18, e.g. a coil spring. The actuation diameter of spring element 18 essentially corresponds to the diameter of the full circle in contact zone C. In order to indicate the spherical convex braking surface 1 of braking body K in FIG. 1 more clearly, the contour of braking surface 1 is extended by dash and dotted lines.

The braking surface respectively supported at carrier 10 could be formed as a unitary structure with carrier 10. Braking element E as well as braking body K suitably are metal- or plastic-form parts of a form stable design. Of particular advantage is to form braking body K and braking element E from light metal and to provide at least on braking surfaces 1, 2 a wear resistant coating.

Figure 2:
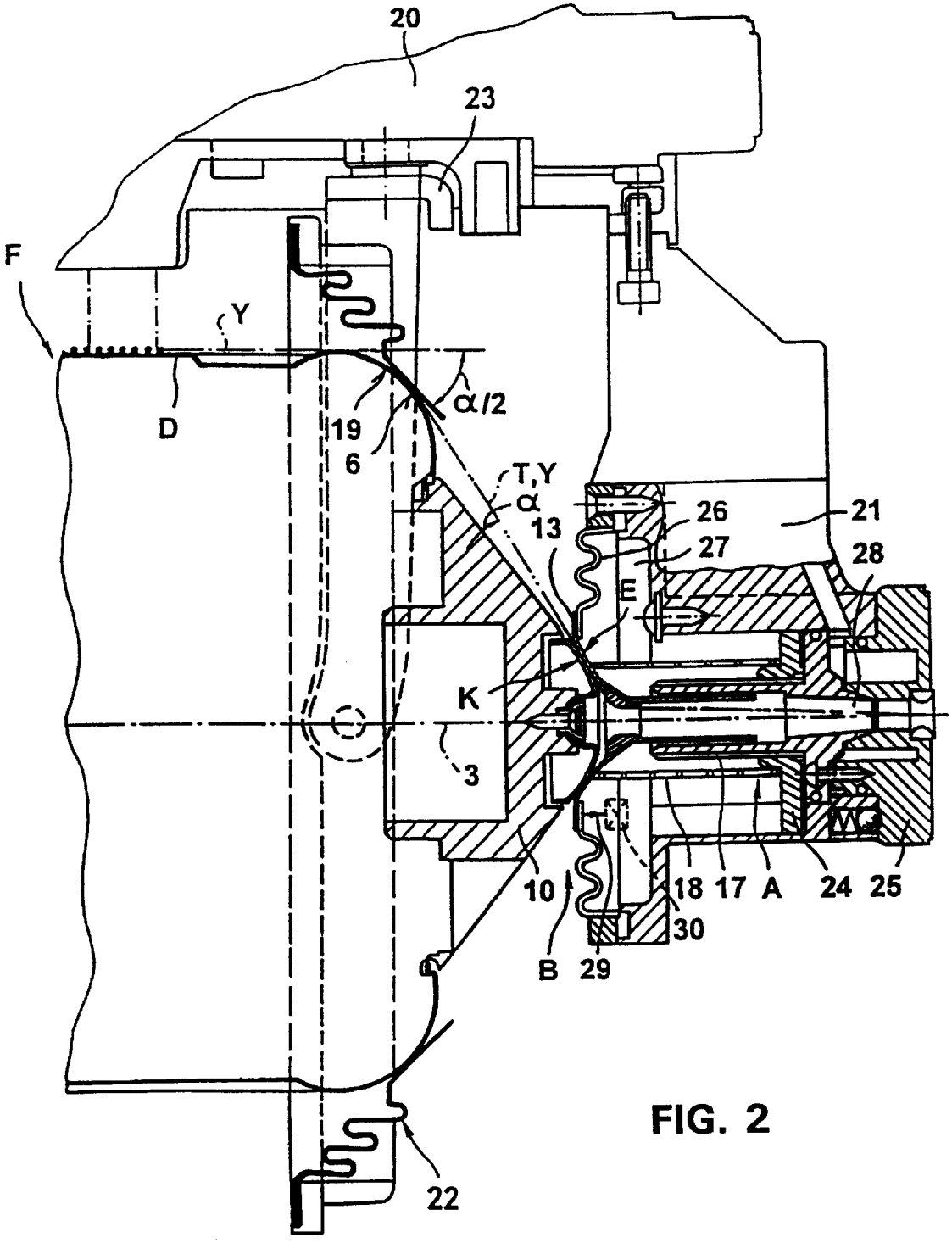
FIG. 2 is a longitudinal section of a front end-section of a yarn feeding device having an axial disc brake.

In FIG. 2 the axial disc brake B (e.g. according to FIG. 1) is structurally integrated into a yarn feeding device F as a so-called weft yarn-output brake. Only a front end section of a storage drum D of said yarn feeding device F is shown together with a housing bracket 20. The yarn feeding device F furthermore is equipped with a housing (not shown) receiving a drive motor for a winding element, a drive shaft for said winding element and a bearing for said storage drum B on which a weft yarn Y for a not shown textile machine, particularly a projectile- or gripper weaving machine, is intermediately stored for later consumption by the weaving machine. Said textile machine draws yarn Y overhead of storage drum D and further in the axial direction (the axis 3 of the axial disc brake B coincides with the axis of storage drum D). The yarn path is indicated in dash dotted lines. A conical nose part of storage drum D forms the carrier 10 for braking body K. At the front end of storage drum D a rounded or conical withdrawal region 19 is provided defining the yarn guiding surface 6 described in connection with FIGS. 1 and 2. During its withdrawal the yarn Y is running over the yarn guiding surface 6 and is rotating like the pointer of a clock in the circumferential direction, before in the direction of the tangent T corresponding to the generatrix of the conical braking surface in the contact zone C of both braking surfaces it enters from the exterior between the braking body K and the braking element E. The yarn is then braked by means of the contact force between both braking surfaces in contact zone C. Subsequently the yarn is deflected into the axial withdrawal direction. In the region of yarn guiding surface 6, yarn Y is deflected inwardly by an angle $\alpha/2$ from the axial direction, i.e. half of the cone angle of the conical braking surface, before it runs in a straight manner into the axial disc brake B. After having passed the contact zone, the yarn Y is again deflected by the angle $\alpha/2$ into the axial withdrawal direction. Advantageously, the cone angle a of the conical braking surface is adapted to the outer diameter of the yarn guiding surface 6 and the axial distance between the yarn guiding surface 6 and the deflection area into the axial disc brake such that the deflections of the yarn at the yarn guiding surface 6 and inside the axial disc brake are approximately the same.

The longitudinal guide or sleeve 17 of braking element E is part of a holding device 21 connected to housing bracket 20. In holding device 21 a brake drive A is provided. In the simplest embodiment spring element 18 serves as brake drive A. Said.spring element 18 is pressing braking element E against braking body K with predetermined axial actuation force which e.g. can be adjusted by means of an adjustment screw 25. An adjustment is carried out by rotating the adjustment screw 25 and adjusting a stop 24 for spring element 18 in the axial direction inside holding device 21. In an alternative embodiment (indicated in dotted lines), a controllable return drive 30 is provided inside holding device 21 which acts upon braking element E counter to the actuation direction of spring element 18, in order to reduce or modulate the braking effect. Said return drive 30 can be actuated depending on the weaving cycles, and e.g. in an electric, electromagnetic or pneumatic manner.

In FIG. 2 the outer edge flange 13 of braking element E is fixed in an annular membrane 26, the outer edge of which is secured at holding device 21 such that membrane 26 defines a boundary of a suction chamber 27 in holding device 21. By connecting suction chamber 27 with a suction pressure source, braking element E can be moved in FIG. 2 to the right side and can be separated completely from braking body K, e.g. in order to allow the threading of a new yarn Y. Inside of holding device 21 in the shown embodiment an ejector-suction- and blowing nozzle 28 is provided by means of which a suction draft can be generated which is active even in between the braking surfaces, and simultaneously a blowing flow directed towards the right side is generated in order to suck in a yarn and to blow it to the right side, which yarn is brought beforehand into the area of the then separated braking surfaces. The suction draft also can directly be used to actuate membrane 26 when it is transferred into suction chamber 27 after actuating ejector nozzle 28. Membrane 26 or return drive 30 generates a forced movement in the direction of an arrow 29 for braking element E.

The rotating pointer movement of the yarn along the yarn guiding surface 6 and into the axial disc brake B is of particular importance for a proper function of the axial disc brake. Since consumption of the yarn Y, e.g. by a weaving machine, takes place intermittently such that during consumption the yarn speed varies, preferably a second yarn braking device 22 is provided upstream of the axial disc brake. Said second yarn braking device 22 is supported in a holder 23 at bracket 20 and cooperates with the withdrawal region 19 of the storage drum. Said second yarn braking device in the shown embodiment is provided with a rubber membrane and a frusto-cone-coat-braking band. It is also possible to use a generally known straw ring or a so-called lamella-brake or a finite band laid flatly onto the storage drum circumference yieldably tensioned by a tensioning device. Said second yarn braking device 22 generates only a low basic tension in the yarn in order to ensure that the yarn Y leaving the windings on the storage drum D towards inlet gap i of the axial disc brake cannot come loose and is running properly, and that a balloon formation is limited or suppressed in this region.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A disc brake arrangement comprising a first brake element defining an axis and a yarn storage area disposed in surrounding relation therewith from which yarn is withdrawn, and a second brake element supported for axial movement relative to said first brake element, said first and second brake elements defining respective brake surfaces which are rotationally symmetrical about the axis and axially pressed against one another with a predetermined contact pressure to define a contact zone therebetween, said braking surfaces together defining a yarn inlet gap adjacent an outer circumference of said arrangement to permit yarn to enter between said braking surfaces, one of said braking surfaces having a spherically-generated convex shape in said contact zone with a radius of curvature which is centered at the axis of said first brake element, and the other said braking surface having a conical shape in said contact zone with a cone axis which substantially coincides with the axis of said first brake element and a generatrix which forms a tangent to said one braking surface.

2. The arrangement of claim 1 wherein each of said first and second brake elements is of a form-stable, substantially rigid construction.

3. The arrangement of claim 1 wherein said one braking surface is defined on said first brake element and said other braking surface is defined on said second brake element, said second brake element being disposed downstream of said first brake element with respect to a direction in which yarn is withdrawn from said yarn storage area, and the cone axis of said braking surface of said second brake element intersects the center of the generating sphere of said braking surface of said first brake element.

4. The arrangement of claim 3 wherein said second brake element has a frusto-conical shape which defines a centrally-located withdrawal opening through which yarn withdrawn from said yarn storage area.

5. A yarn feeding device for a textile machine, said yarn feeding device comprising a yarn storage drum defining an axis and having a front end which defines a yarn withdrawal region disposed in surrounding relation with the axis, a disc brake oriented coaxially relative to said storage drum adjacent said front end thereof, said disc brake including first and second braking surfaces which are rotationally symmetrical about the axis and are axially pressed against one other to define a contact zone therebetween, said first braking surface having a convex shape in said contact zone with a radius of curvature centered at the axis of said storage drum, and said second braking surface having a conical shape in said contact zone with a cone axis which substantially coincides with the axis of said storage drum and a generatrix which forms a tangent to said first braking surface in said contact zone.

6. The arrangement of claim 5 further including first and second brake elements respectively defining said first and second braking surfaces thereon, said first brake element being disposed at said front end of said storage drum and said second brake element being disposed downstream of both said storage drum and said first brake element with respect to a direction in which yarn is withdrawn from said storage drum, each of said first and second brake elements having a form-stable, substantially rigid construction.

7. The arrangement of claim 5 further including first and second brake elements respectively defining said first and second braking surfaces thereon, said first brake element being mounted on said front end of said storage drum and said second brake element being supported for axial movement relative to said first brake element in a holding device spaced from said storage drum, said holding device including a drive for generating a force in at least one axial direction to actuate said second braking element.

8. The arrangement of claim 7 wherein said first brake element is mounted at said front end of said storage drum by a fixing element which permits both limited tilting and limited radial displacement of said first brake element relative to the axis of said storage drum.

9. The arrangement of claim 8 wherein said first brake element is constructed of metal or plastic and has a partially spherical shape with an edge flange which projects away from said second brake element and is oriented substantially parallel to the axis of said storage drum to prevent yarn from being caught behind said first brake element, said first brake element further including a central depression in which said fixing element is disposed.

10. The arrangement of claim 9 wherein said second brake element has a frustoconical shape with an outer edge flange oriented transversely relative to the axis of said storage drum and a centrally oriented funnel-shaped yarn withdrawal opening having a funnel angle which is less than a cone angle defined between said second braking surface in said contact zone and the axis of said storage drum.

11. The arrangement of claim 10 including a membrane fixed to said outer edge flange of said second brake element which along with said holding device forms a suction chamber connected to a suction pressure source such that upon pressurization of said suction chamber, said second brake element is moved away from said first brake element to allow threading of a yarn between said first and second braking surfaces.

12. The arrangement of claim 7 wherein said drive includes a spring element which is disposed to bias said second brake element towards said first brake element, and an electrically, electromagnetically or pneumatically actuable return drive connected to said second brake element to apply a force thereto in opposition to the biasing force of said spring element.

13. The arrangement of claim 7 wherein said drive includes a spring element which contacts said second brake element in a circle which substantially corresponds to a circular configuration of said contact zone.

14. The arrangement of claim 5 wherein said yarn withdrawal region defines a circular yarn-guiding surface and the generatrix of said second braking surface is approximately tangent to said yarn guiding surface.

15. The arrangement of claim 14 wherein said contact zone is circular and a diameter thereof is between about 10% and about 50% of a maximum diameter of said yarn guiding surface.

16. The arrangement of claim 15 wherein the diameter of said contact zone is about 20% of the maximum diameter of said yarn guiding surface.

17. The arrangement of claim 5 further including first and second brake elements respectively defining said first and second braking surfaces thereon, said first brake element being disposed adjacent said front end of said storage drum and said second brake element being disposed downstream of said first brake element with respect to a direction in which yarn is withdrawn from said storage drum, said first and second brake elements comprising lightweight metal parts and each said first and second braking surface including a wear-resistant coating thereon.

18. The arrangement of claim 5 wherein said first braking surface is formed integrally with said storage drum and said second braking surface is defined on a brake element supported for axial movement relative to said first braking surface in a holding device spaced from said storage drum, said holding device including a drive for generating a force in at least one axial direction to actuate said brake element.

19. The arrangement of claim 5 wherein said storage drum is configured to store yarn in windings thereon, said arrangement further including first and second brake elements respectively defining said first and second braking surfaces thereon, said first brake element being disposed at said front end of said storage drum and said second brake element being supported for axial movement relative to said first brake element, said second brake element being disposed downstream of both said storage drum and said first brake element with respect to a yarn withdrawal direction and defining a centrally located yarn withdrawal opening oriented generally along the axis of said storage drum such that yarn withdrawn from said storage drum travels between said first and second braking surfaces and is displaced generally radially into said yarn withdrawal opening and thereafter travels in a direction substantially parallel to the axis of said storage drum.

20. The arrangement of claim 19 wherein said contact zone defined between said first and second braking surfaces has the shape of a circle with a diameter which remains constant during braking.

* * * * *